US009240168B1

(12) United States Patent
Steinberger

(10) Patent No.: US 9,240,168 B1
(45) Date of Patent: Jan. 19, 2016

(54) STRING MUSICAL INSTRUMENT HAND SUPPORT APPARATUS

(71) Applicant: Nancy Ann Steinberger, Lakewood, CO (US)

(72) Inventor: Nancy Ann Steinberger, Lakewood, CO (US)

( * ) Notice: Subject to any disclaimer, the term of this patent is extended or adjusted under 35 U.S.C. 154(b) by 0 days.

(21) Appl. No.: 14/611,243

(22) Filed: Feb. 1, 2015

(51) Int. Cl.
*G10D 3/18* (2006.01)

(52) U.S. Cl.
CPC ..... *G10D 3/18* (2013.01)

(58) Field of Classification Search
CPC ..... G10D 3/18
See application file for complete search history.

(56) References Cited

U.S. PATENT DOCUMENTS 401,814 A * 4/1889 Bohmann ..... G10D 3/18 84/328
491,755 A * 2/1893 Le Valley ..... G10D 3/18 84/328
D210,851 S * 4/1968 Wallace ..... 84/328
3,375,747 A * 4/1968 Posey ..... G10D 3/00 84/267
D302,435 S * 7/1989 Pearse ..... D17/20
D381,356 S * 7/1997 Pelkey ..... 84/328
8,927,839 B2 * 1/2015 Hammack ..... G10D 3/18 84/328

* cited by examiner

*Primary Examiner* — Robert W Horn
(74) *Attorney, Agent, or Firm* — Roger A. Jackson

(57) ABSTRACT

A removably engagable string musical instrument hand support apparatus that includes a beam having a first end portion and a second end portion, a principal surface, a minor surface, and a peripheral surface. Further included are first and second extension members that both extend from the minor surface, wherein the extension members contact a body of the musical instrument and the beam forms a non-contacting scaffold over a string of the musical instrument. Also included is an elastic finger having a primary end portion affixed to the peripheral surface and a secondary end portion affixed to an opposing peripheral surface, the primary and secondary ends both oppositely depend away from the beam towards the body with the ends having structure to removably engage opposing features of the body. Wherein the beam principal surface supports a user's hand over the musical instrument string for instrument playing.

17 Claims, 12 Drawing Sheets

STRING MUSICAL INSTRUMENT HAND SUPPORT APPARATUS

RELATED PATENT APPLICATIONS

There are no related patent applications.

TECHNICAL FIELD

The present invention relates generally to a hand support for string musical instruments. More particularly, the present invention of the string musical instrument hand support apparatus is particularly suited for musical string instruments thus facilitating a hand or wrist rest to allow the strings of the musical instrument to be more easily played to improve speed, tone, accuracy, and to have less hand/wrist fatigue.

BACKGROUND OF INVENTION

Musical string instruments to be played necessitate that the user initiates a vibration via contacting a string being termed picking, plucking, strumming, or striking the selected string of the instrument, wherein the string contact is usually in a rapid sequential movement, wherein multiple strings are contacted in close proximity to one another repeatedly in quick succession. The musical stringed instruments can include guitar, banjo, mandolin, and the like that are typically "plucked" string instruments not "bowed" such as a violin. The user typically positions their hand and/or a portion of their wrist adjacent to a grouping of strings and utilizes one or more of their fingers to strike the string directly or to maneuver a plectrum to accomplish the string contact.

When the user is playing the stringed instrument, common practice is to position the plucking hand by one of three techniques: (1) hovering the hand above the string, (2) anchoring the pinky finger on the top of the instrument body, and (3) resting a portion of the hand on the bridge, top of the instrument body, or on one or more strings. Although the tone and flexibility of the hovering method is optimal, it is extremely difficult to engage the string accurately. Speed can also be limited, since there is no fixed pivot point for rocking the wrist or the hand. In addition, tension and fatigue can be a problem in the hand, wrist, and arm since nothing is being supported. By anchoring the pinky finger on the top of the instrument body, the player has support and a tactile reference point to the string locations, thereby increasing accuracy. However, stiffness in the anchor finger can impact the agility of the other fingers and the hand, increasing tension and fatigue, plus limiting speed.

Also, the location of the anchor point is determined by the player's hand size, and can negatively impact the tone by changing the vibration of the instrument top or body. Resting the hand on the bridge, the top of the instrument body, or on one or more strings provides a support, a tactile reference point to the string locations, and a fixed pivot point for rocking the wrist or hand, however, the tone is often impacted by dampening the vibration of the bridge, the instrument body, or the strings. In addition, the anchor point is again determined by the player's hand size, which may not be optimal for tone production. Unless the user's fingers are extremely long, a player resting their hand on the bridge will strike the strings in a location too close to the bridge, resulting in a bright, harsh tone. Thus, what is needed is a hand rest that provides a tactile reference point to the string locations to improve accuracy, a support to reduce tension and fatigue, a fixed pivot point for rocking the wrist or hand to improve speed, and an adjustable positioning to optimize tone for various hand sizes.

In looking at the prior art in the stringed instrument hand/wrist support arts, in United States Patent Application Publication Number 2013/0213207 to Hammack disclosed is a permanently attached hand rest for a guitar or other such stringed instrument configured to be positioned over strings of the stringed instrument such that a user of the stringed instrument may rest a hand on at least a portion of the hand rest while using the stringed instrument, see FIGS. 1 to 4. Furthermore, in Hammack the hand rest is configured to not interfere with a user striking one or more strings and the vibration of one or more strings, see in particular FIGS. 5 to 7.

Also, in Hammack the hand rest can be pivoted out of the way when it is desired to not use the hand rest, see FIGS. 7 and 8. However, Hammack requires that the hand rest be permanently installed leaving holes in the stringed instrument body, see FIGS. 4 to 8, although in FIGS. 1 to 3, for an acoustic guitar there is shown a screw clamping mechanism for the sound opening of the acoustic guitar body for a removable engagement of the hand rest, however, the clamping mechanisms protrude above the guitar, interfering with the motion of the hand while strumming. In addition, the clamping mechanism would leave crimping marks due to high unit area loading in the body wall, as the body wall is constructed of a relatively soft material, see FIG. 3 in particular.

Further looking at the prior art in the stringed instrument hand/wrist support arts, in U.S. Design Pat. No. D210,851 to Wallace disclosed is a hand rest for guitars or similar articles. The hand rest in Wallace appears to permanently attach to the string bridge fastener on one side of the bridge, with no accommodation of the hand rest offsetting the bridge on one side which could interfere with the string sound function, and which is not movable for different hand positions.

Next, looking at the prior art in the stringed instrument rest/support arts, in U.S. Pat. No. 1,156,925 to Poehland disclosed is a violin shoulder rest that attaches with elastic loops about portions of the violin body. Poehland is for a shoulder rest only and has no scaffold type suspension support over the strings of the violin as the Poehland shoulder rest is disposed opposite of the string side of the body being positioned in-between the violin body and the player/user support shoulder, see in particular FIG. 4.

Further looking at the prior art in the stringed instrument hand/wrist support arts, in German Patent Publication DE10053401 to Heers disclosed is a bridge suspended over the guitar string instrument strings that is attached to the string instrument body via a laterally adjustable "T-Slot" arrangement that is affixed to the body, see in particular FIGS. 21 and 22. Thus, Heers requires permanent holes to be put into the body while allowing for only lateral adjustment, i.e. parallel to the body surface only along the string length.

Continuing in looking at the prior art in the stringed instrument hand/wrist support arts, in U.S. Design Pat. No. D381,356 to Pelkey disclosed is a guitar hand rest. Pelkey appears to have again a permanent attachment of a "U" shaped hand rest to an electric (solid body) guitar being adjacent to the string bridge.

Further continuing in looking at the prior art in the stringed instrument hand/wrist support arts, in U.S. Pat. No. 401,814 to Bohmann disclosed is a string musical instrument having an arm-rest hollowed in the direction of its length to conform to the player's arm, and standing at an angle to the top of the instrument corresponding to the natural angle of the user's hand and arm. Bohmann also has a permanent pivotal attachment of the arm/hand rest on the string instrument body.

In addition, looking at the prior art in the stringed instrument accessory arts pertaining to a rhythm beating and hand/ wrist support in U.S. Pat. No. 3,375,747 to Posey disclosed is a guard plate for a stringed instrument such as a guitar including a body from which an elongated neck projects, the strings of the instrument extending from the free end portion of the neck along the latter to a remote portion of said body. The guard plate in Posey comprising a panel-like body including one side surface which is roughened and being adapted for securement to the guitar body along one side of the strings with one side surface of said guard body facing outwardly of the guitar body. Posey also has a permanent attachment of the rhythm beating pad/arm/hand rest on the string instrument body.

What is needed is a string musical instrument hand support apparatus that attaches to the stringed musical instrument in a way that is removably engagable, that in effect creates no permanent holes, markings, grooves, and the like so as not to damage the stringed musical instrument, as many of which have fine finishes and soft thin structures for acoustics that can be easily damaged. Further, the string musical instrument hand support apparatus needs to be secure and stable as attached to the body of the instrument for proper playing by the user, while at the same time the hand support needs to be easily attachable and removable to the body of the stringed musical instrument, and adjustable to different positions for the best tone and hand size.

SUMMARY OF INVENTION

Broadly, the present invention is a hand support apparatus for a string musical instrument having a body that includes a prime surface, the body including retention features, and a string retention bridge disposed upon the prime surface such that a string is suspended away from the prime surface. The hand support apparatus includes a beam having a longitudinal axis, the beam having a first end portion and an opposing second end portion with the longitudinal axis spanning therebetween the first end portion and the second end portion. The beam further having a principal surface and an opposing minor surface, wherein the principal surface and the minor surface span the beam both being substantially parallel to the longitudinal axis, with the beam also having a peripheral surface.

Further included in the hand support apparatus is a first extension member having a first axis, the first extension member having a first proximal portion and an opposing first distal portion with the first axis spanning therebetween the first proximal portion and the first distal portion, the first extension member also having a first perimeter surface, the first proximal portion is affixed to the beam first end portion on the minor surface, the first axis is positioned substantially perpendicular to the beam longitudinal axis.

In addition, included on the hand support apparatus is a second extension member having a second axis, the second extension member having a second proximal portion and an opposing second distal portion with the second axis spanning therebetween the second proximal portion and the second distal portion, the second extension member also having a second perimeter surface, the second proximal portion is affixed to the beam second end portion on the minor surface, with the second axis being positioned substantially perpendicular to the beam longitudinal axis. Wherein the first axis and the second axis are positioned substantially parallel to one another and the first extension member and the second extension member both extend away from the beam in substantially a same direction, such that the first extension member, the beam, and the second extension member form a "U" shape termed an arch, with the arch having an arch axis, wherein the peripheral surface, the first perimeter surface, and the second perimeter surface forming a flank surface.

Continuing, also included on the hand support apparatus is an elastic finger having a primary end portion and an opposing secondary end portion, the primary end portion is affixed on one end to the flank surface and the primary end portion depends away from the principal surface in a direction toward the first and second extension members on an opposing end of the primary end portion having a means for removable engaging a body retention feature. The secondary end portion is affixed on one end to the flank surface opposite of the primary end portion and the secondary end portion depends away from the principal surface in a direction toward the first and second extension members on an opposing end of the secondary end portion having a means for removable engagement to an opposing body retention feature. Wherein operationally, the first and second distal portions are drawn to be adjacent to the prime surface via the elastic finger with the minor surface forming a non-contacting scaffold over the string and the principal surface forming a hand rest for a player of the string musical instrument, wherein the hand support apparatus is removably engagable to the string musical instrument.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
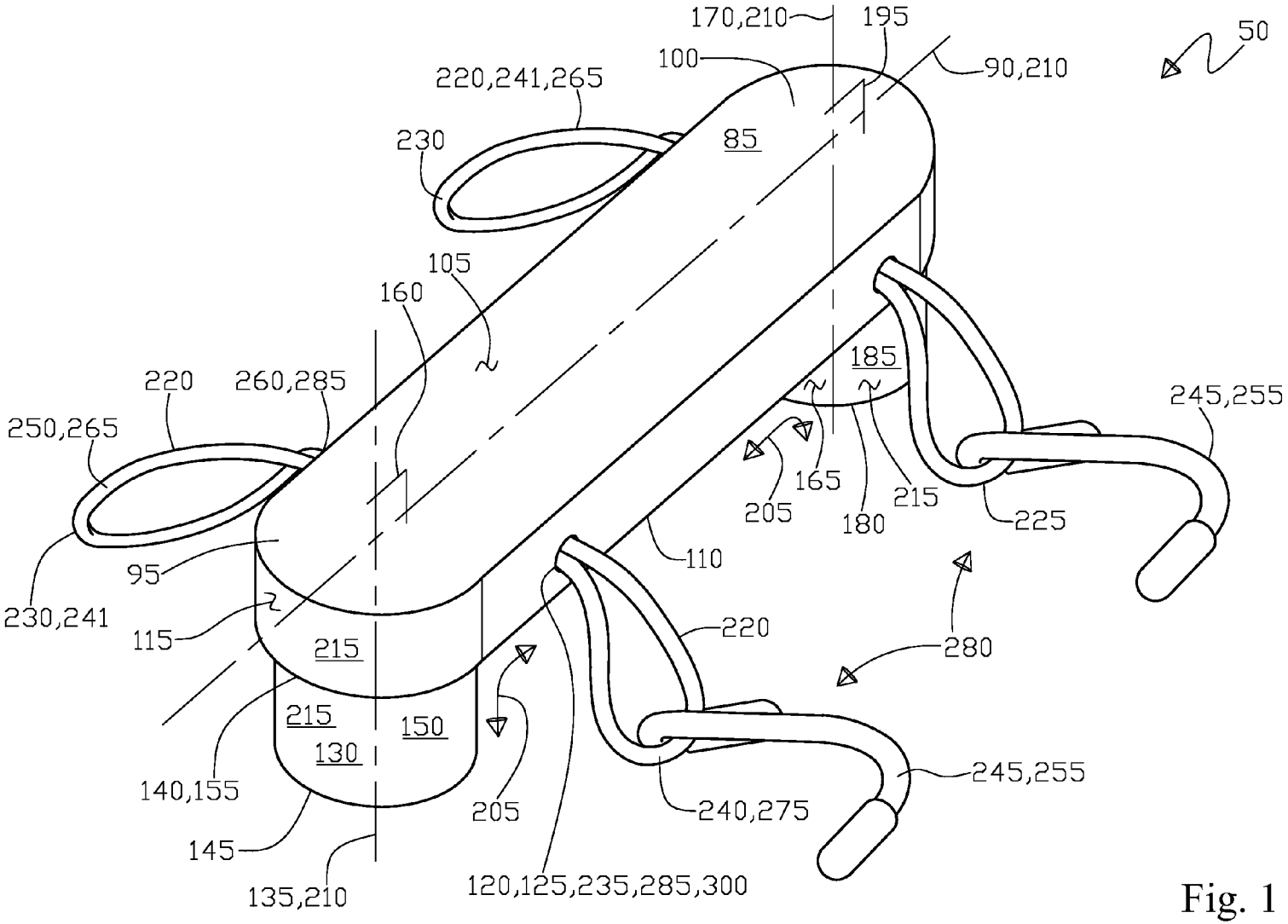
FIG. 1 shows a perspective view of the hand support apparatus disengaged from the musical instrument showing the beam, the first and second end portions of the beam, the principal and minor surfaces of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having primary and secondary end portions that are each affixed to the flank surface and on the opposing ends of the primary and secondary end portions having the means for removable engagement to the body retention features of the musical instrument.

50 Hand Support Apparatus
55 String musical instrument
60 Body of the string musical instrument 55
65 Prime surface of the string musical instrument 55
70 Retention feature of the body 60 for the string musical instrument 55
75 Opposing retention feature of the body 60 for the string musical instrument 55
80 String retention bridge of the string musical instrument 55
81 String of the string musical instrument 55
82 Player or user of the string musical instrument 55
85 Beam
90 Longitudinal axis of the beam 85
95 First end portion of the beam 85
100 Second end portion of the beam 85
105 Principal surface of the beam 85
110 Minor surface of the beam 85
115 Peripheral surface of the beam 85
120 Cavity of the beam 85 disposed therethrough the beam 85 between the principal 105 and minor 110 surfaces
125 Plurality of the cavities 120 that are each positioned in a spaced apart manner along the longitudinal axis 90
130 First extension member
135 First axis of the first extension member 130
140 First proximal portion of the first extension member 130
145 First distal portion of the first extension member 130
150 First perimeter surface of the first extension member 130
155 Affixment of the first proximal portion 140 to the beam first end portion 95 minor surface 110
160 Perpendicular position of the first axis 135 to the longitudinal axis 90
165 Second extension member
170 Second axis of the second extension member 165
175 Second proximal portion of the second extension member 165
180 Second distal portion of the second extension member 165
185 Second perimeter surface of the second extension member 165
190 Affixment of the second proximal portion 175 to the beam second end portion 100 minor surface 110
195 Perpendicular position of the second axis 170 to the longitudinal axis 90
200 Substantially parallel position of the first 135 and second 170 axes
205 "U" shaped arch of the first extension member 130, the beam 85, and the second extension member 165
210 Axis of the "U" shaped arch 205 that is formed from the longitudinal axis 90, the first axis 135, and the second axis 170
215 Flank surface formed from the peripheral surface 115, the first perimeter surface 150, and the second perimeter surface 185
220 Elastic finger
225 Primary end portion of the elastic finger 220
230 Secondary end portion of the elastic finger 220
235 Affixment of the primary end portion 225 to the flank surface 215
240 Opposing terminal end of the primary end portion 225
241 Opposing terminal end of the secondary end portion 230
245 Means for removable engaging the body retention feature 70
250 Loop of the elastic finger 220 for the means 245, 265 for removable engaging the body retention feature 70
255 Malleable soft surface "S" hook of the elastic finger 220 for the means 245, 265 for removably engaging an opposing body retention feature 75
260 Affixment of the secondary end portion 230 opposite of the primary end portion 225 affixment 235
265 Means for removable engaging the opposing body retention feature 75
270 Scaffold that is non-contacting over the string 81 via the beam 85 and first 130 and second 165 extension members
275 Hand rest for a player 82
280 Spaced apart manner of positioning of a plurality of the elastic fingers 220
285 Affixment of the primary 225 and secondary 230 end portions to the peripheral surface 115
290 Affixment of the primary 225 and secondary 230 end portions to the first perimeter surface 150
295 Affixment of the primary 225 and secondary 230 end portions to the second perimeter surface 185
300 Elastic finger 220 disposed therethrough the cavity 120 in a slidable engagement
305 Initial elastic finger
310 Primary end portion of the initial elastic finger 305
315 Secondary end portion of the initial elastic finger 305
320 Following elastic finger
325 Primary end portion of the following elastic finger 320
330 Secondary end portion of the following elastic finger 320

335 Contact of the initial primary end portion 310 with the peripheral surface 115

340 Contact of the initial secondary end portion 315 with the peripheral surface 115 in an opposing direction

345 Contact of the following primary end portion 325 with an opposing end of the peripheral surface 115

355 Contact of the following secondary end portion 330 with the peripheral surface 115 in an opposing direction

DETAILED DESCRIPTION

With initial reference to FIG. 1 shown is a perspective view of the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 1 are the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 1 is the elastic finger 220 having a primary 225 and secondary 230 end portions that are each affixed 235, 260 to the flank surface 215 and on the opposing ends of the primary 225 and secondary 230 end portions having the means 245 for removable engagement for the body 60 retention feature 70 of the string musical instrument 55.

Figure 2:
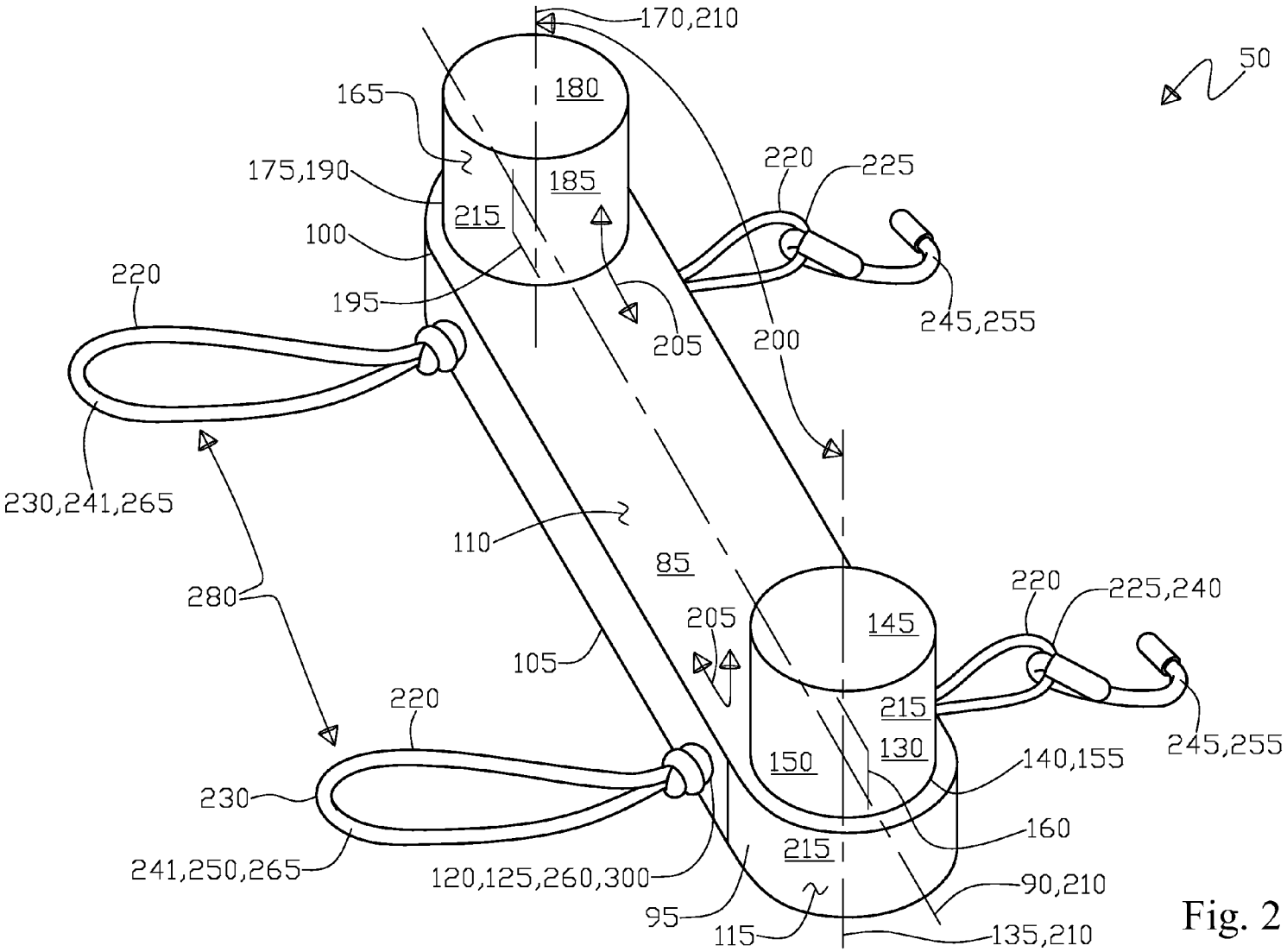
FIG. 2 shows an opposing perspective view of the hand support apparatus in relation to FIG. 1 that has the hand support apparatus disengaged from the musical instrument showing the beam, the first and second end portions of the beam, the principal and minor surfaces of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having primary and secondary end portions that are each affixed to the flank surface and on the opposing ends of the primary and secondary end portions having the means for removable engagement to the body retention features of the musical instrument.

Continuing, FIG. 2 shows an opposing perspective view of the hand support apparatus 50 in relation to FIG. 1 that has the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 2 is the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 2 is the elastic finger 220 having the primary 225 and secondary 230 end portions that are each affixed 235, 260 to the flank surface 215 and on the opposing ends of the primary 225 and secondary 230 end portions having the means 245 for removable engagement for the body 60 retention feature 70 of the string musical instrument 55.

Figure 3:
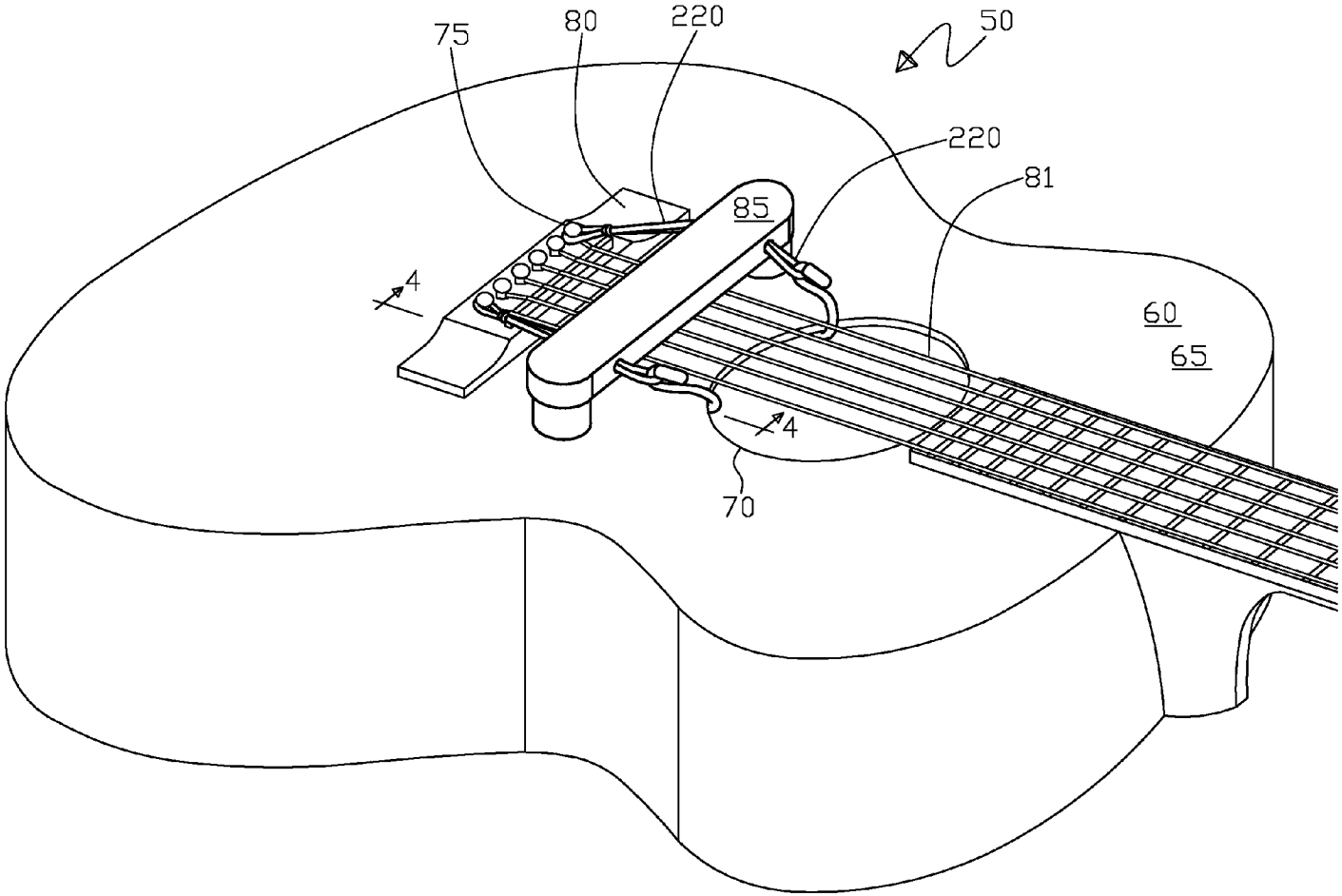
FIG. 3 shows a perspective view of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument.

Next, FIG. 3 shows a perspective view of the hand support apparatus 50 installed upon the string musical instrument 55 with the means 265 for removable engagement engaging opposing body 60 retention feature 75 of the string musical instrument 55 in effect holding down the hand support apparatus 50 to the prime surface 65 of the string musical instrument 55 body 60 without any permanent markings or openings disposed on the string musical instrument 55 wherein the hand support apparatus 50 is removable from the string musical instrument 55.

Figure 4:
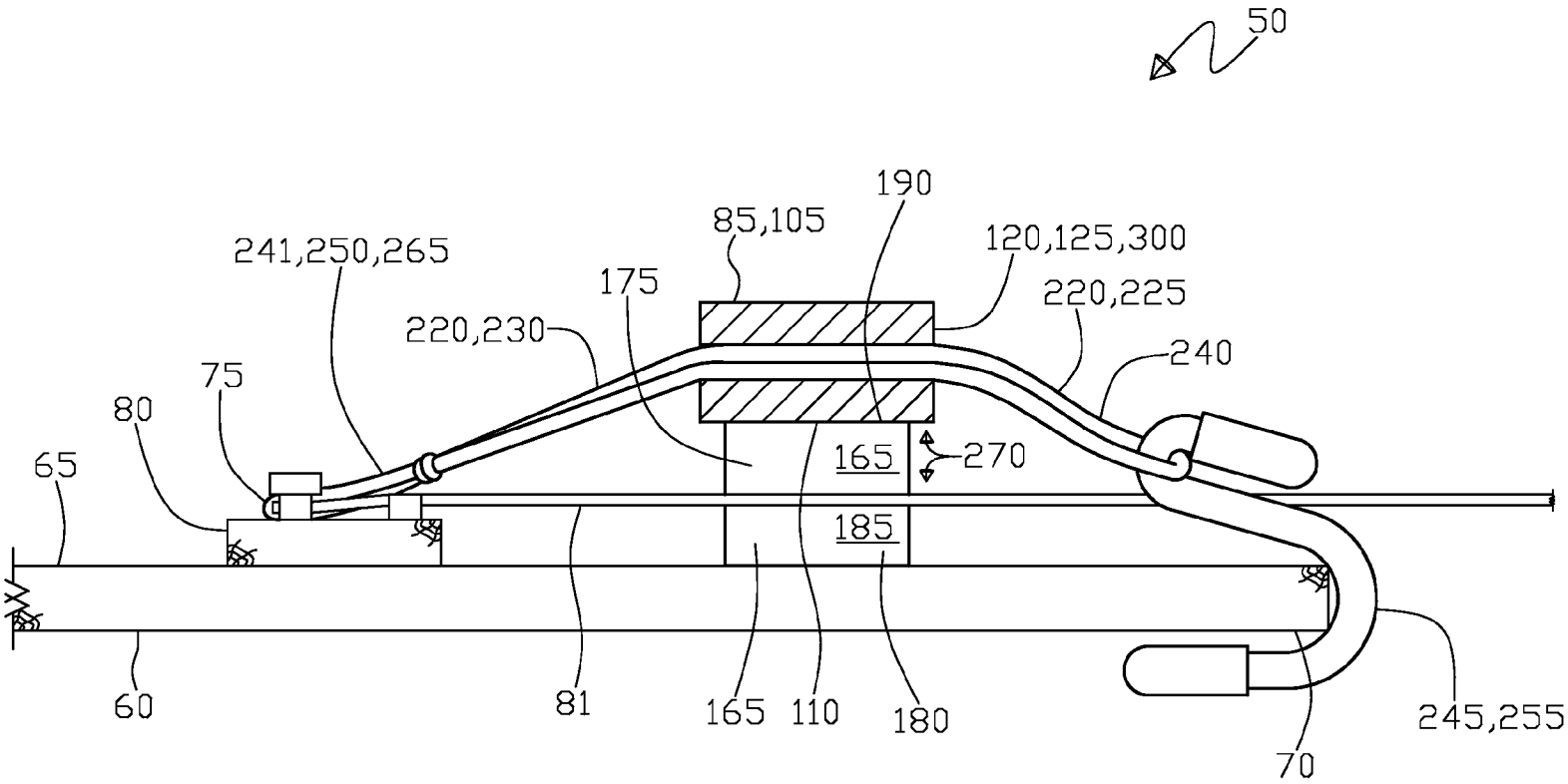
FIG. 4 shows cross section cut 4-4 from FIG. 3 to show a detailed view of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, further shown is a cavity of the beam that the elastic finger is slidably engaged with, also shown is the elastic finger having a primary end portion adjacent to the peripheral surface and a secondary end portion adjacent to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Further, FIG. 4 shows cross section cut 4-4 from FIG. 3 to show a detailed view of the hand support apparatus 50 installed upon the string musical instrument 55 with the means 265 for removable engagement engaging opposing body 60 retention features 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 4 is the cavity 120 of the beam 85 that the elastic finger 220 is slidably engaged 300 with, also shown is the elastic finger 220 having a primary end portion 225 adjacent to the peripheral surface 115 and a secondary end portion 230 adjacent to an opposing peripheral surface 115, the primary 225 and secondary 230 ends both oppositely depend away from the beam 85 towards the body 60 with the ends 225, 230 having the means 265 to removably engage opposing feature 75 of the body 60. Also shown in FIG. 4 wherein the beam 85 principal surface 105 supports a player user's 82 hand over the string musical instrument 55 string 81 in the form of a scaffold 270 that is non-contacting over the string 81 for instrument 55 playing.

Figure 5:
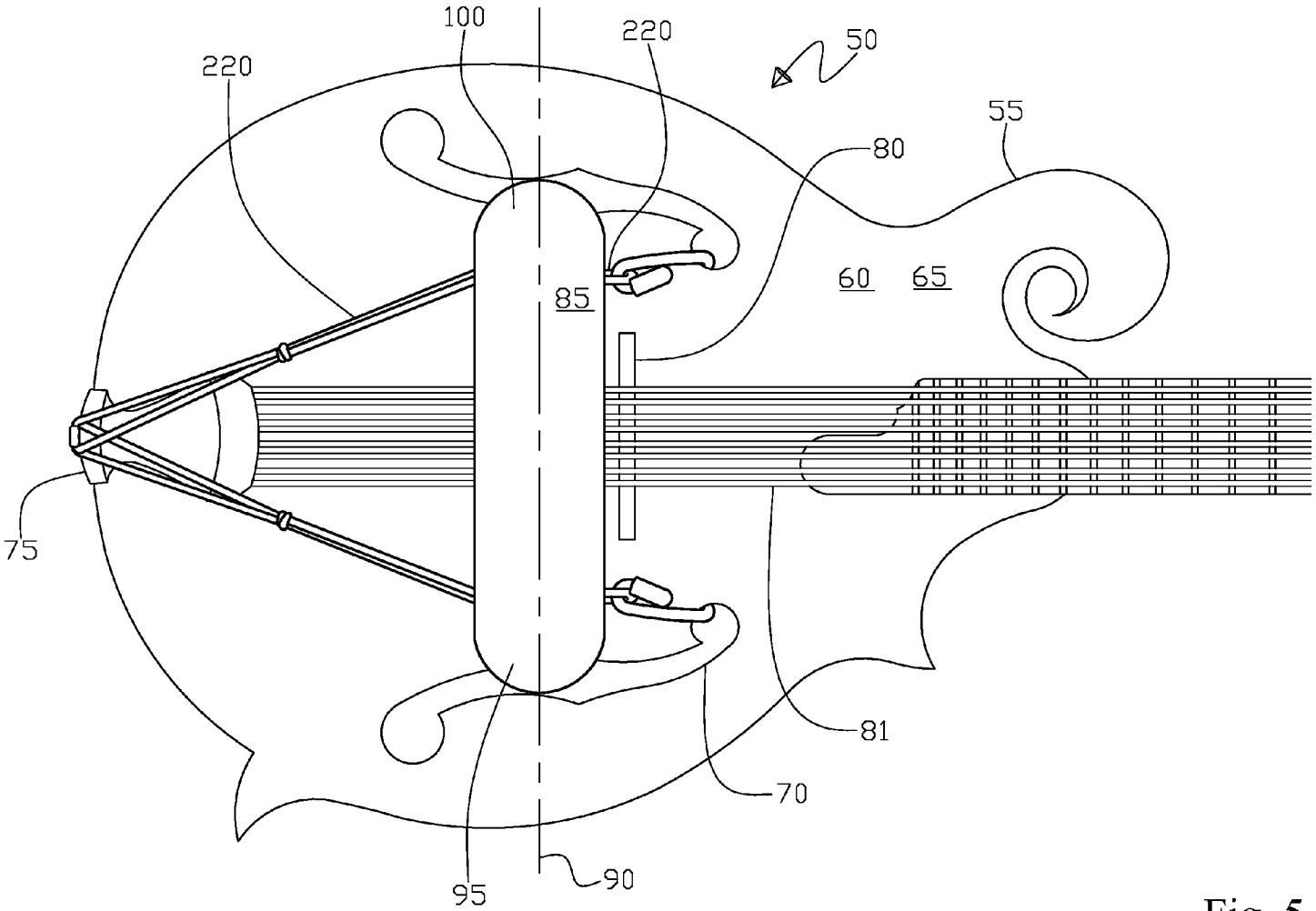
FIG. 5 shows a plan view of the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Yet further, FIG. 5 shows a plan view of the hand support apparatus 50 installed upon the string musical instrument 55 being positioned behind the string retention bridge 80 with the means 265 for removable engagement engaging opposing body 60 retention feature 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 5 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 265 to removably engage opposing retention features 70, 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 6:
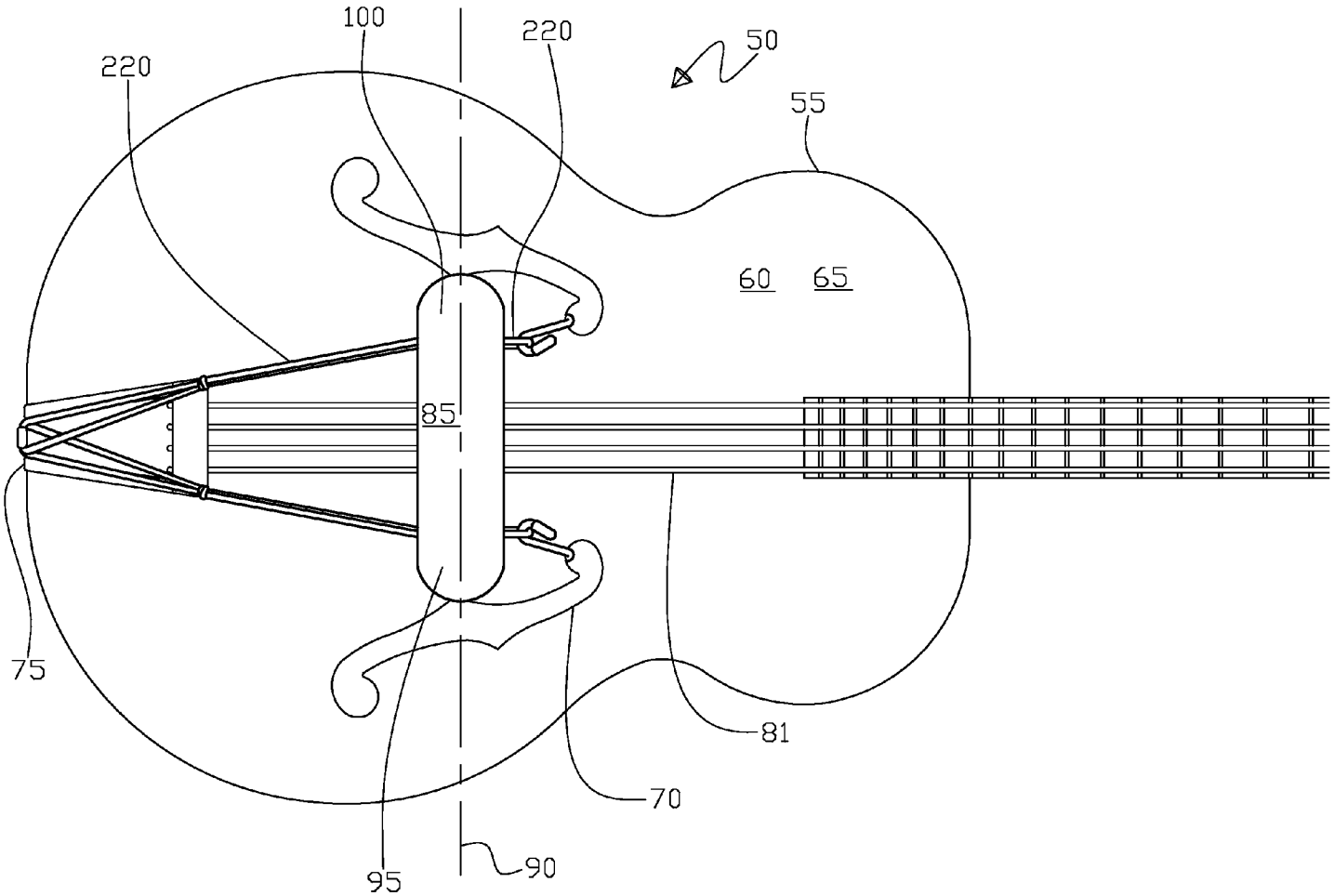
FIG. 6 shows a plan view of the hand support apparatus installed upon the musical instrument straddling above the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Moving onward, FIG. 6 shows a plan view of the hand support apparatus 50 installed upon the string musical instrument 55 straddling above the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 6 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 265 to removably engage opposing features 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 7:
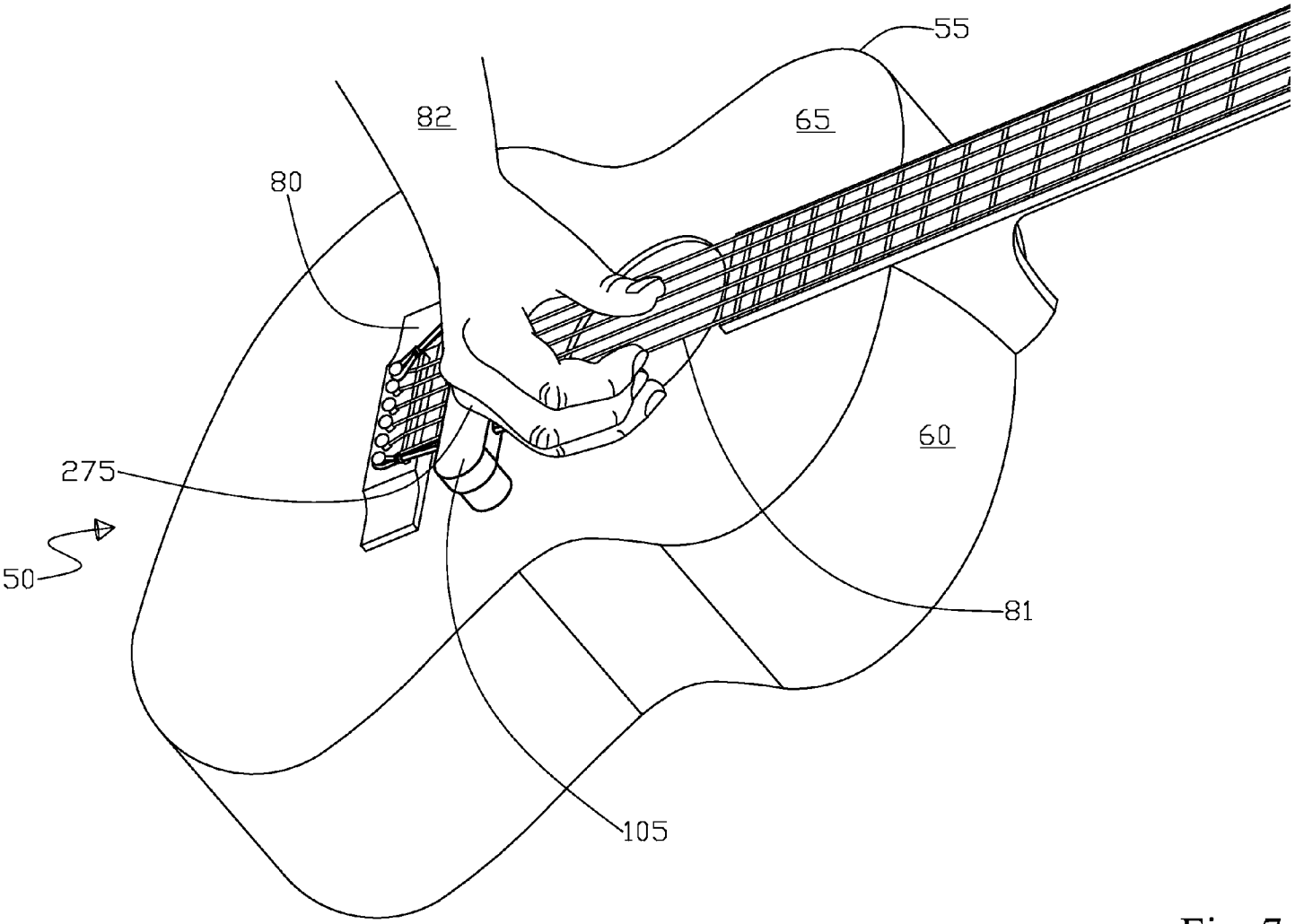
FIG. 7 shows a perspective view of the hand support apparatus installed and in use upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, wherein the player of the musical instrument is resting their hand upon the beam or more particularly the principal surface of the beam to be suspended over the string of the musical instrument.

Continuing, FIG. 7 shows a perspective view of the hand support apparatus 50 installed and in use upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55, wherein the player or user 82 of the string musical instrument 55 is resting their hand upon the beam 85 or more particularly the principal surface 105 of the beam 85 to be suspended over the string 81 of the string musical instrument 55.

Figure 8:
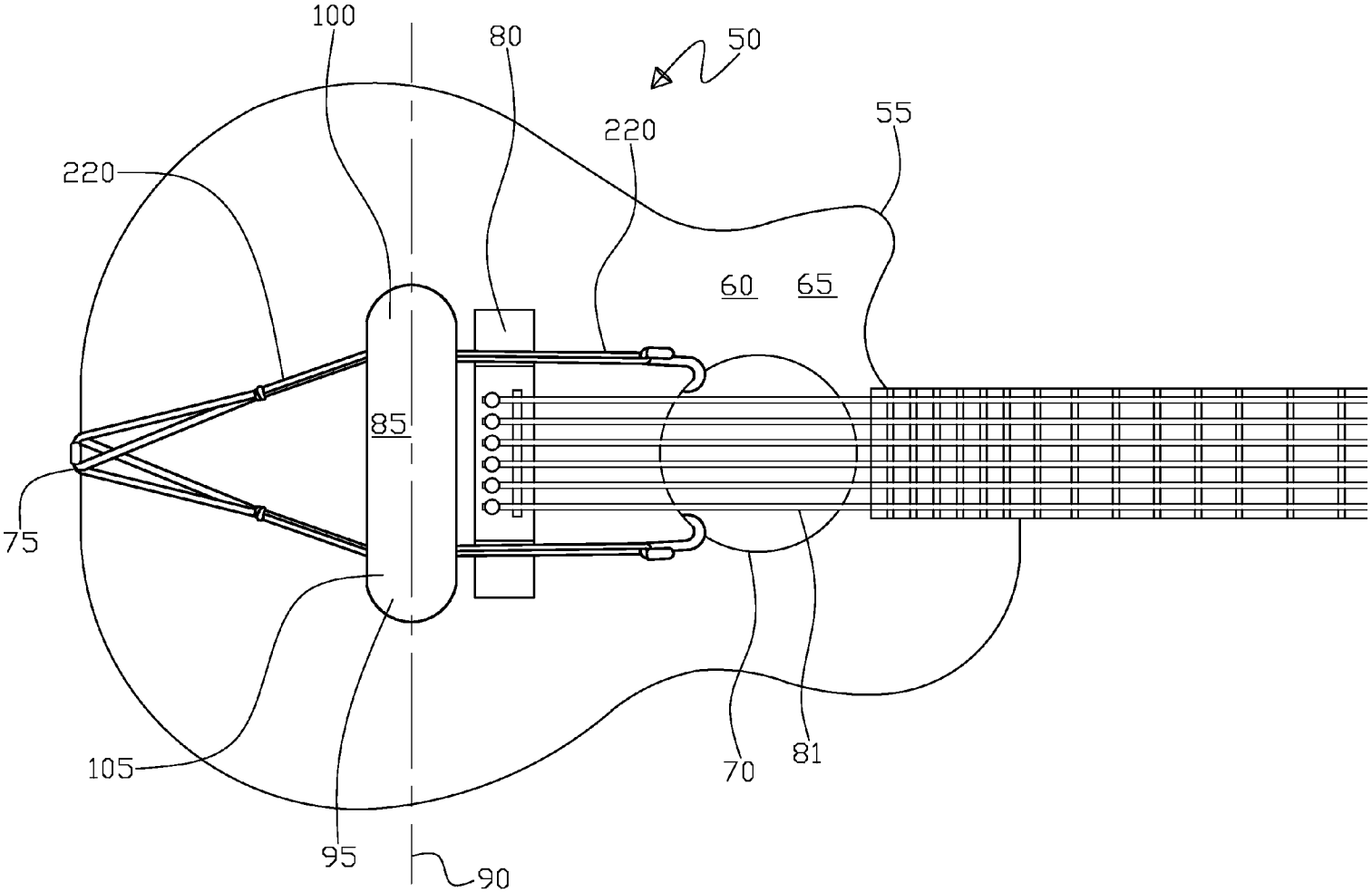
FIG. 8 shows a plan view of the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion affixed to the peripheral surface and a secondary end portion affixed to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Yet further, FIG. 8 shows a plan view of the hand support apparatus 50 installed upon the string musical instrument 55 being positioned behind the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 8 is the elastic finger 220 having a primary end portion 225 affixed to the peripheral surface 115 and a secondary end portion 230 affixed to an opposing peripheral surface 115, the primary 225 and secondary 230 ends both oppositely depend away from the beam 85 towards the body 60 with the ends having the means 245, 265 to removably engage opposing features 70, 75 of the body 60, wherein the beam 85 principal surface 105 supports a player user's 82 hand over the string musical instrument 55 string 81 in the form of a scaffold 270 that is non-contacting over the string 81 for string instrument 55 playing by the player user 82.

Figure 9:
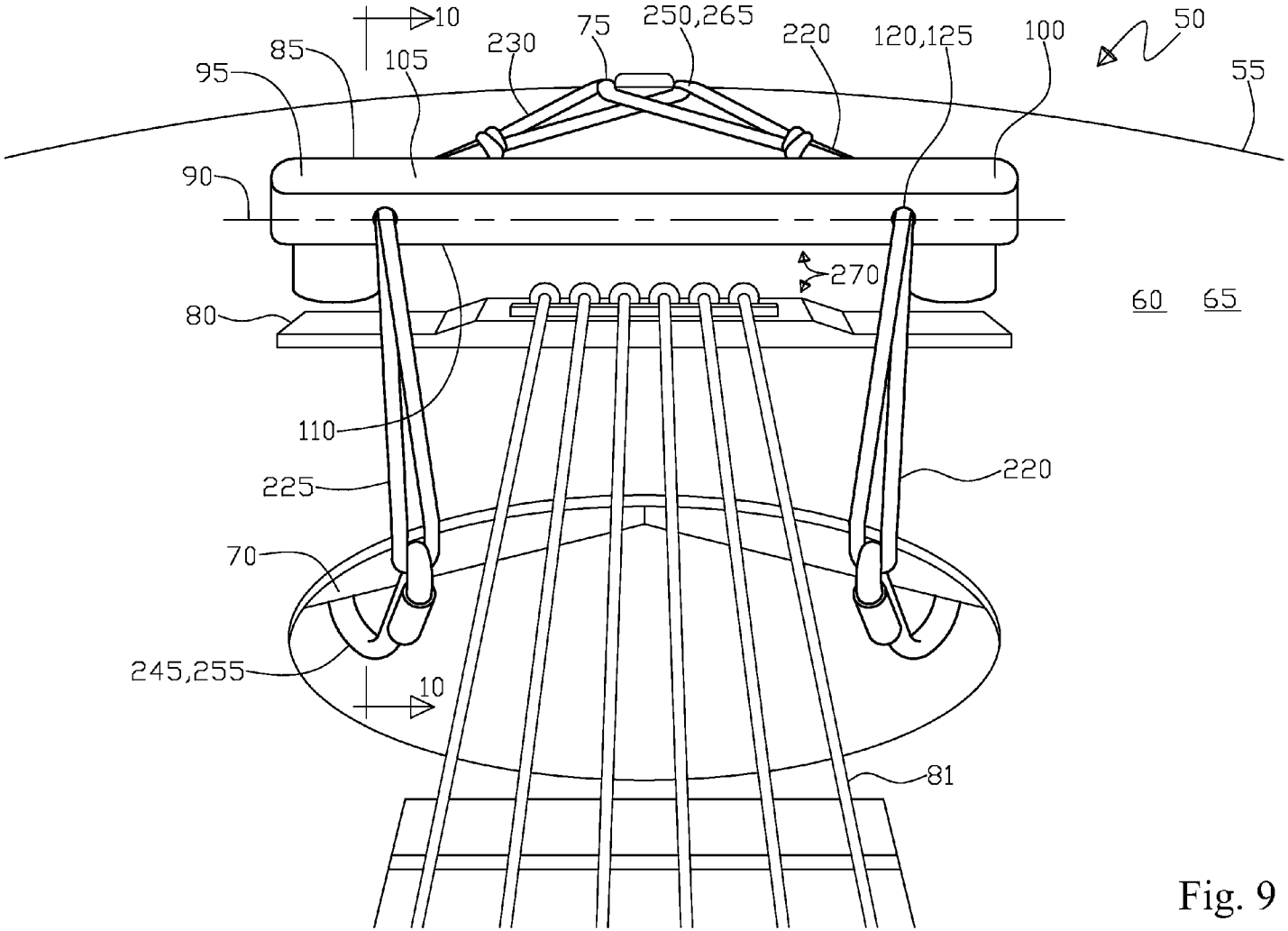
FIG. 9 shows a side elevation view from a neck side of the musical instrument for the hand support apparatus installed upon the musical instrument being positioned behind the string retention bridge with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, also shown is the elastic finger having a primary end portion slidably engaged to the beam cavity adjacent to the peripheral surface and a secondary end portion slidably engaged to the beam cavity adjacent to the opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting on the beam minor surface over the string for instrument playing.

Further, FIG. 9 shows a side elevation view from a neck side of the string musical instrument 55 for the hand support apparatus 50 installed upon the string musical instrument 55 being positioned behind the string retention bridge 80 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Also shown in FIG. 9 is the elastic finger 220 having a primary end portion 225 slidably engaged 300 to the beam 85 cavity 120 adjacent to the peripheral surface 115 and the secondary end portion 230 slidably engaged 300 to the beam 85 cavity 120 adjacent to the opposing peripheral surface 115, the primary 225 and secondary 230 ends both oppositely depend away from the beam 85 towards the body 60 with the ends 225, 230 having the means 245, 265 to removably engage opposing features 70, 75 of the body 60, wherein the beam 85 principal surface 105 supports the player user's 82 hand over the string musical instrument 55 string 81 in the form of a scaffold 270 that is non-contacting on the beam 85 minor surface 110 over the string 81 for string instrument 55 playing by the player 82.

Figure 10:
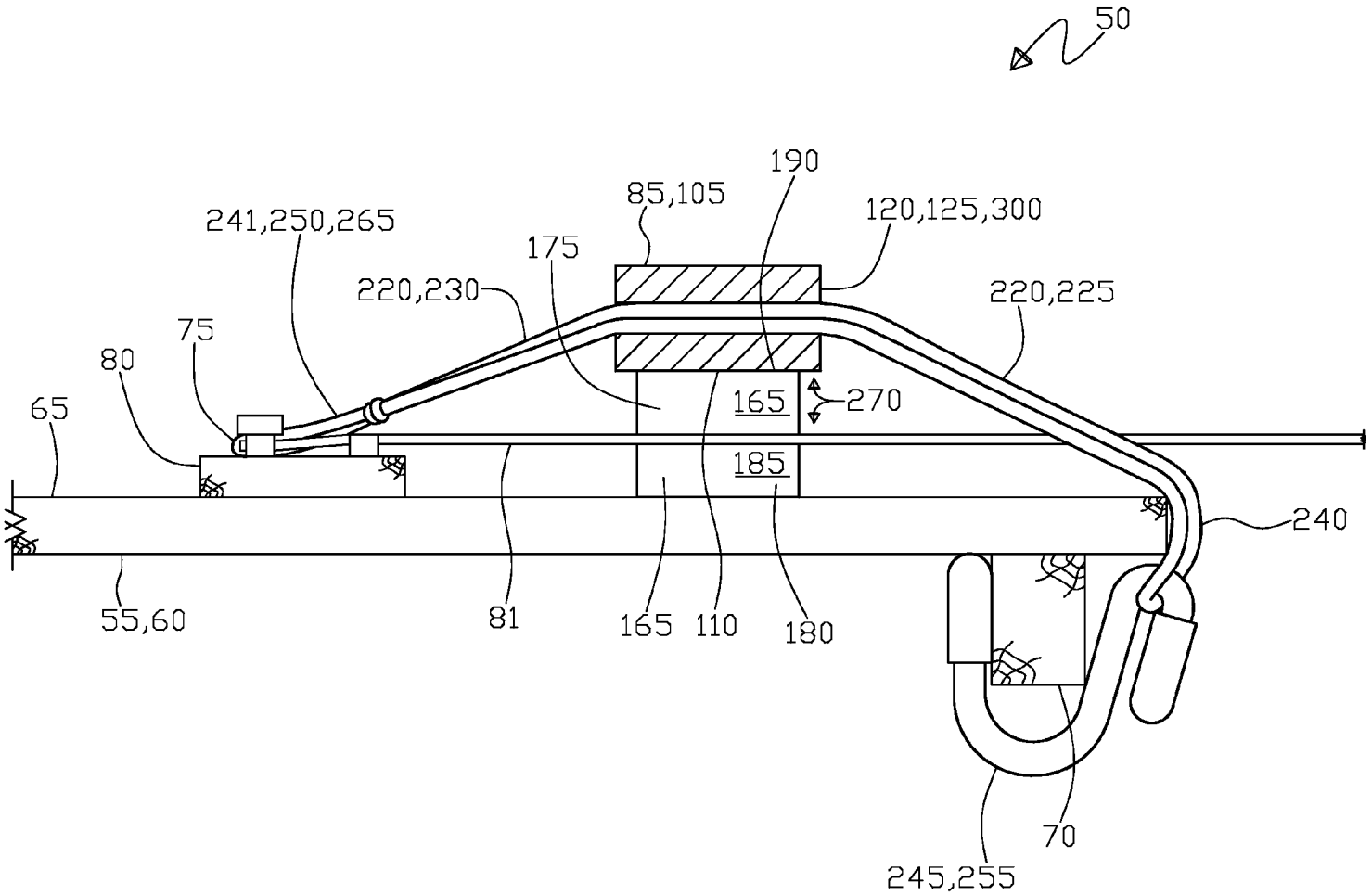
FIG. 10 shows cross section cut 10-10 from FIG. 9 to show a detailed view of the hand support apparatus installed upon the musical instrument however, with FIG. 9 showing the hand support apparatus that can be positioned behind the string retention bridge and FIG. 10 showing the hand support apparatus that can be positioned in front of the string retention bridge with the means for removable engagement engaging opposing body retention features of the musical instrument in effect holding down the hand support apparatus to the prime surface of the musical instrument body without any permanent markings or openings disposed on the musical instrument wherein the hand support apparatus is removable from the musical instrument, further shown is a cavity of the beam that the elastic finger is slidably engaged with, also shown is the elastic finger having a primary end portion adjacent to the peripheral surface and a secondary end portion adjacent to an opposing peripheral surface, the primary and secondary ends both oppositely depend away from the beam towards the body with the ends having the means to removably engage opposing features of the body, wherein the beam principal surface supports a user's hand over the musical instrument string in the form of a scaffold that is non-contacting over the string for instrument playing.

Next, FIG. 10 shows cross section cut 10-10 from FIG. 9 to show a detailed view of the hand support apparatus 50 installed upon the string musical instrument 55 however, with FIG. 9 showing the hand support apparatus 50 that can be positioned behind the string retention bridge 80 and FIG. 10 showing the hand support apparatus 50 that can be positioned in front of the string retention bridge 80. Thus, FIG. 10 shows a detailed view of the hand support apparatus 50 installed upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 10 is the cavity 120 of the beam 85 that the elastic finger 220 is slidably engaged 300 with, also shown is the elastic finger 220 having a primary end portion 225 adjacent to the peripheral surface 115 and a secondary end portion 230 adjacent to an opposing peripheral surface 115, the primary 225 and secondary 230 ends both oppositely depend away from the beam 85 towards the body 60 with the ends 225, 230 having the means 245, 265 to removably engage opposing features 70, 75 of the body 60. Also shown in FIG. 10 wherein the beam 85 principal surface 105 supports a player user's 82 hand over the string musical instrument 55 string 81 in the form of a scaffold 270 that is non-contacting over the string 81 for instrument 55 playing.

Figure 11:
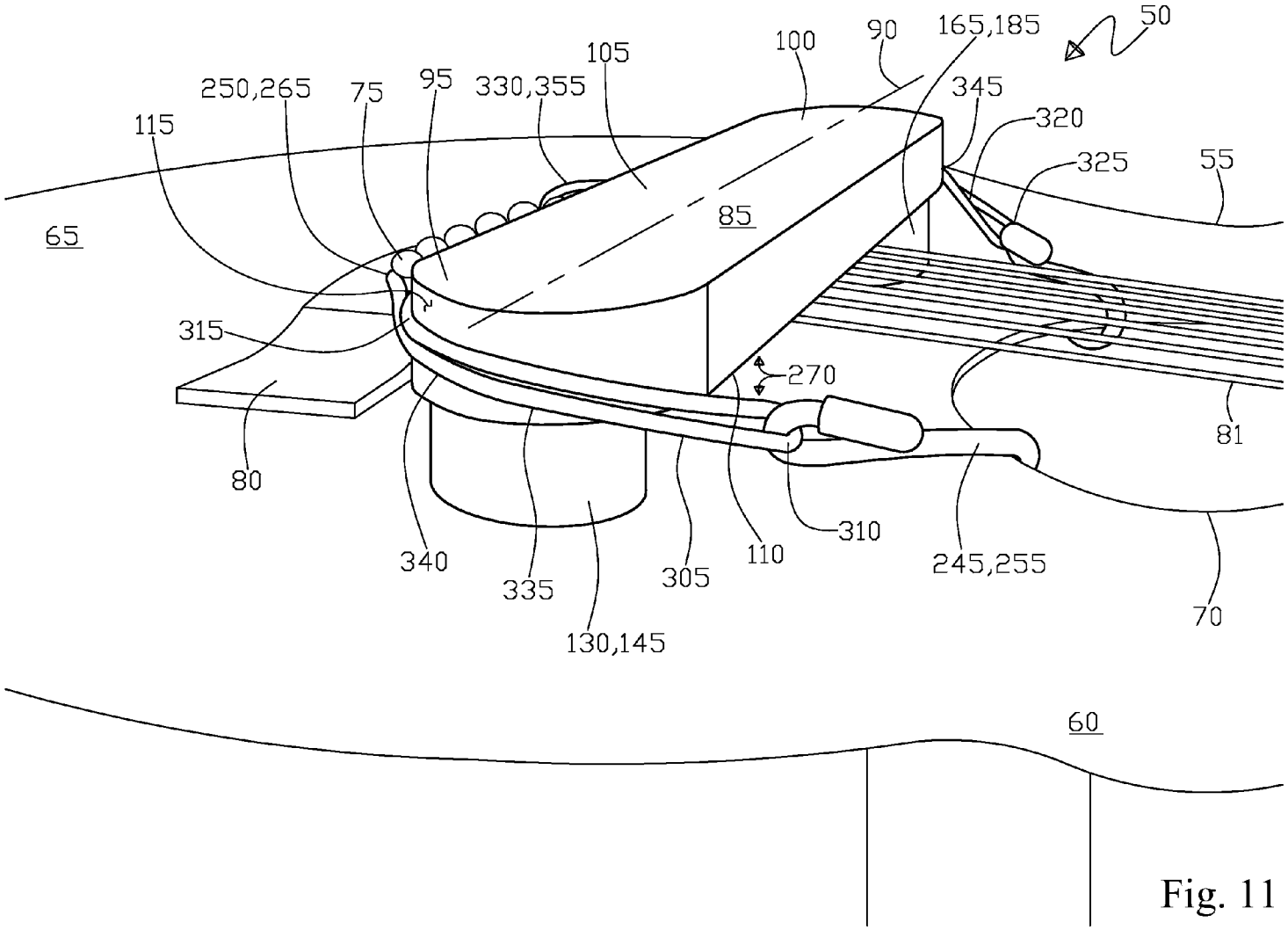
FIG. 11 shows a perspective view of a further alternative embodiment of the hand support apparatus installed upon the musical instrument with the means for removable engagement engaging opposing body retention features of the musical instrument in effect holding down the hand support apparatus to the prime surface of the musical instrument body without any permanent markings or openings disposed on the musical instrument, wherein the hand support apparatus is removable from the musical instrument, further shown are the initial elastic finger with its primary and secondary end portions and the following elastic finger with its primary and secondary end portions along with the non-affixed contacts of the primary and secondary end portions for both the initial and following elastic fingers with the contacts being adjacent to the peripheral surface of the beam, and the means for removable engagement to the opposing body retention features on the primary and secondary end portions, wherein the initial and following elastic fingers in effect compress the beam and pull it toward the prime surface being supported by the first and second extension members to form the scaffold of the beam over the musical instrument string.

Continuing, FIG. 11 shows a perspective view of a further alternative embodiment of the hand support apparatus 50 installed upon the string musical instrument 55 with the means 245, 265 for removable engagement engaging opposing body 60 retention features 70, 75 of the string musical instrument 55 in effect holding down the hand support apparatus 50 to the prime surface 65 of the string musical instrument 55 body 60 without any permanent markings or openings disposed on the string musical instrument 55, wherein the hand support apparatus 50 is removable from the string musical instrument 55. Further shown in FIG. 11 is the initial elastic finger 305 with its primary 310 and secondary end 315 portions and the following elastic finger 320 with its primary 325 and secondary 330 end portions along with the non-affixed contacts 335, 340, 345, 355 of the primary 310, 325 and secondary 315, 330 end portions for both the initial 305 and following 320 elastic fingers with the contacts 335, 340, 345, 355 being adjacent to the peripheral surface 115 of the beam 85, and the means 245, 265 for removable engagement to the opposing body 60 retention features 70, 75 on the primary 310, 325 and secondary 315, 330 end portions. Wherein FIG. 11 shows the initial 305 and following 320 elastic fingers in effect compress the beam 85 and pull it toward the prime surface 65 being supported by the first 130 and second 165 extension members to form the scaffold 270 of the beam 85 over the string musical instrument 55 string 81.

Figure 12:
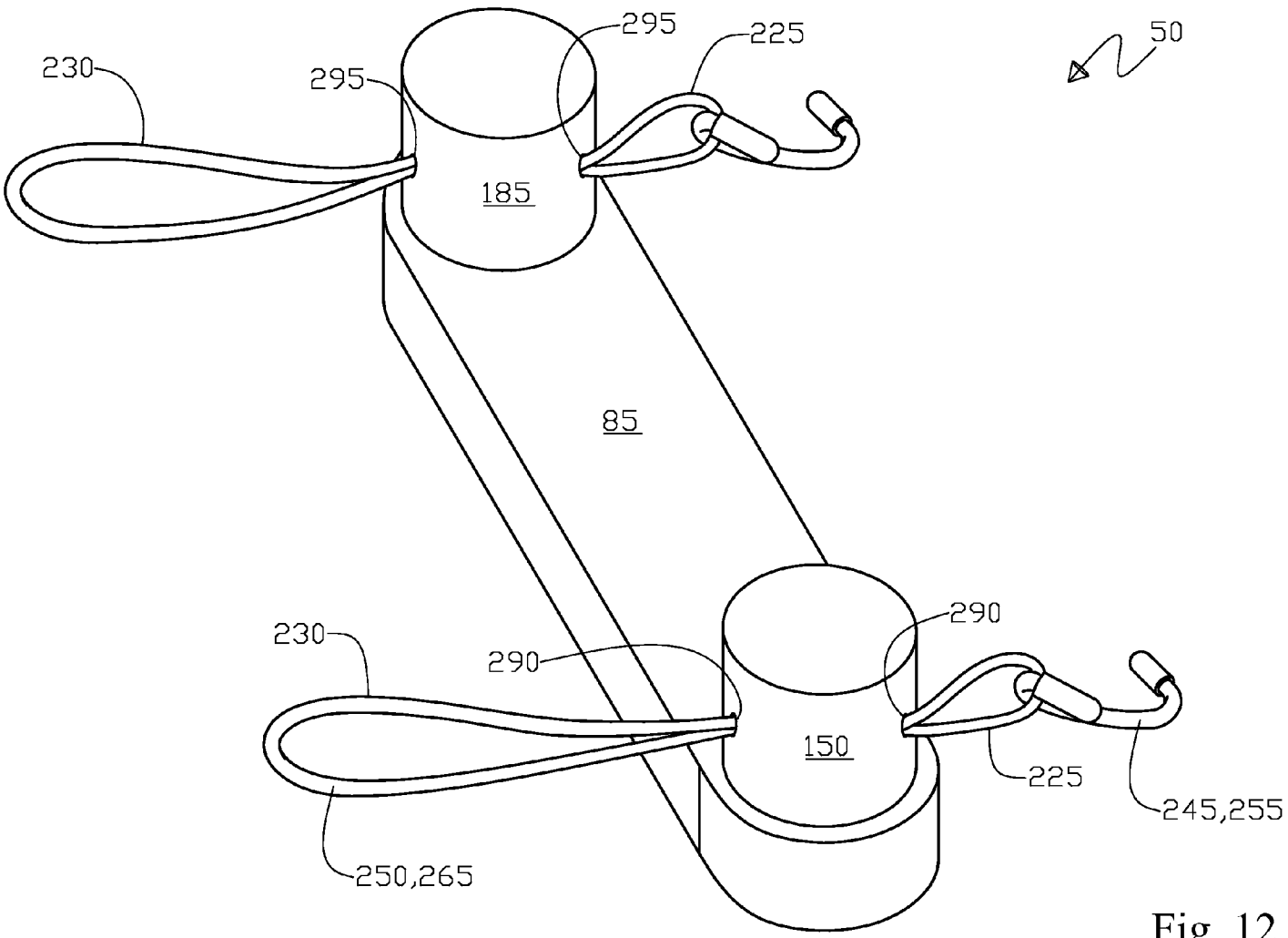
FIG. 12 shows an perspective view of another alternative embodiment of the hand support apparatus that has the hand support apparatus disengaged from the musical instrument showing the beam, the first and second end portions of the beam, the principal and minor surface of the beam, along with the peripheral surface and cavity of the beam, further shown are the first and second extension members with their respective first and second proximal end portions plus the first and second distal end portions, and first and second perimeter surfaces, with the beam and first and second extension members forming a "U" shaped arch with a flank surface formed from the peripheral surface and the first and second perimeter surfaces, also shown is the elastic finger having a primary and secondary end portion that are each affixed to the first and/or second perimeter surfaces of the first and second extension members and on the opposing ends of the primary and secondary end portions having the means for removable engagement for the body retention features of the musical instrument.

Further, FIG. 12 shows an perspective view of another alternative embodiment of the hand support apparatus 50 that has the hand support apparatus 50 disengaged from the string musical instrument 55 showing the beam 85, the first 95 and second 100 end portions of the beam 85, the principal 105 and minor 110 surfaces of the beam 85, along with the peripheral surface 115 and cavity 120 of the beam 85. Further shown in FIG. 12 are the first 130 and second 165 extension members with their respective first 140 and second 175 proximal end portions plus the first 145 and second 180 distal end portions, and first 150 and second 185 perimeter surfaces, with the beam 85 and first 130 and second 165 extension members forming a "U" shaped arch 205 with a flank surface 215 formed from the peripheral surface 115 and the first 150 and second 185 perimeter surfaces. Also shown in FIG. 12 is the elastic finger 220 having a primary 225 and secondary 230 end portions that are each affixed 290, 295 to the first 150 and/or second 185 perimeter surfaces of the first 130 and second 165 extension members and on the opposing ends of the primary 225 and secondary 230 end portions having the means 245, 265 for removable engagement for the body 60 retention features 70, 75 of the string musical instrument 55.

Broadly, the present invention is shown in FIGS. 1 to 12 for the hand support apparatus 50 for the string musical instrument 55 having the body 60 that includes the prime surface 65, the body 60 including opposing retention features 70, 75, and the string retention bridge 80 disposed upon the prime surface 65 such that the string 81 is suspended away from the prime surface 65, as best shown in FIGS. 4 and 10. The hand support apparatus 50 includes the beam 85 having a longitudinal axis 90, the beam 85 having the first end portion 95 and an opposing second end portion 100 with the longitudinal axis 90 spanning therebetween the first end portion 95 and the second end portion 100, as best shown in FIGS. 1 and 2. The beam 85 further having the principal surface 105 and the opposing minor surface 110, wherein the principal surface 105 and the minor surface 110 span the beam 85 both being substantially parallel to the longitudinal axis 90, with the beam 85 also having the peripheral surface 115, again see FIGS. 1 and 2.

Further included in the hand support apparatus 50 is the first extension member 130 having the first axis 135, the first extension member 130 having the first proximal portion 140 and an opposing first distal portion 145 with the first axis 135 spanning therebetween the first proximal portion 140 and the first distal portion 145, the first extension member 130 also having the first perimeter surface 150, wherein the first proximal portion 155 is affixed to the beam 85 first end portion 95 on the minor surface 110, the first axis 135 is positioned substantially perpendicular 160 to the beam 85 longitudinal axis 90, as shown best in FIGS. 1 and 2.

In addition, included on the hand support apparatus 50 is a second extension member 165 having the second axis 170, the second extension member 165 having a second proximal portion 175 and an opposing second distal portion 180 with the second axis 170 spanning therebetween the second proximal portion 175 and the second distal portion 180, the second extension member 165 also having the second perimeter surface 185, wherein the second proximal portion 175 is affixed 190 to the beam 85 second end portion 100 on the minor surface 110, with the second axis 170 being positioned substantially perpendicular 195 to the beam 85 longitudinal axis 90, see FIGS. 1 and 2. Wherein the first axis 135 and the second axis 170 are positioned substantially parallel 200 to one another and the first extension member 130 and the second extension member 165 both extend away from the beam 85 in substantially a same direction, such that the first extension member 130, the beam 85, and the second extension member 165 form a "U" shape 205 termed an arch, with the arch having an arch axis 210, wherein the peripheral surface 115, the first perimeter surface 150, and the second perimeter surface 185 forming a flank surface 215, again see FIGS. 1 and 2.

Continuing, also included on the hand support apparatus 50 is the elastic finger 220 having the primary end portion 225 and an opposing secondary end portion 230, the primary end portion 225 is affixed 235 on one end to the flank surface 215 and the primary end portion 225 depends away from the principal surface 105 in a direction toward the first 130 and second 165 extension members on an opposing end of the primary end portion 225 having the means 245 for removable engaging the body 60 retention feature 70. The secondary end portion 230 is affixed 260 on one end to the flank surface 215 opposite of the primary end portion 225 and the secondary end portion 230 depends away from the principal surface 105 in a direction toward the first 130 and second 165 extension members on an opposing end of the secondary end portion 230 having the means 265 for removable engagement to an opposing body 60 retention feature 75, again see FIGS. 1 and 2. Wherein operationally, the first 145 and second 180 distal portions are drawn to be adjacent to the prime surface 65 via the elastic finger 220 with the minor surface 110 forming a non-contacting scaffold 270 over the string 81 and the principal surface 105 forming a hand rest 275 for a player 82 of the string musical instrument 55, wherein the hand support apparatus 50 is removably engagable to the string musical instrument 55, see in particular FIG. 7, also FIGS. 3 to 6, and 8 to 10.

Alternatively, the hand support apparatus 50 can further comprise a plurality of the elastic fingers 220 that are each positioned in a spaced apart manner 280 along the arch axis 210, for the operational purpose of symmetric hold down loading of the hand support apparatus 50 as against the prime surface 65, as shown in particular in FIGS. 1 and 2, plus in FIGS. 3, 5, 6, 8, and 9. In addition, alternatively for the hand support apparatus 50 wherein the elastic finger 220 primary end portion 225 and the elastic finger 220 secondary end portion 230 can be affixed 285 to the peripheral surface 115, see in particular FIGS. 1 and 2.

Also optionally, on the hand support apparatus 50 the elastic finger 220 primary end portion 225 and the elastic finger 220 secondary end portion 230 are affixed 290 to the first perimeter surface 150, as best shown in FIG. 12. Further optionally, on the hand support apparatus 50 the elastic finger 220 primary end portion 225 and the elastic finger 220 secondary end portion 230 are affixed 290 to the second perimeter surface 185, also as best shown in FIG. 12.

Another option, on the hand support apparatus 50 the means 265 for removable engaging the body 60 opposing retention feature 75 is preferably constructed of a loop 250 of the elastic finger 220 that removably engages the body 60 opposing retention feature 75, see FIGS. 1, 2, 5, 6, 8, 9, and 12. Yet another option, on the hand support apparatus 50 the means 245 for removable engaging the body 60 retention feature 70 is preferably constructed of a malleable soft surface "S" hook 255 that is sized and configured to removably engage the body retention feature 70, as best shown in FIGS. 1, 2, 3, 4, 5, 6, 7, 8, 10, 11, and 12. Further, on the hand support apparatus 50 the first 130 and second 165 extension members are preferably constructed of a pliable material to firstly not damage or mark the prime surface 65 and to provide a higher degree of friction as between the first 130 and second 165 extension members and particularly the first 145 and second 180 distal portions and the prime surface 65 for securing the hand support apparatus 50 to the string musical instrument 55.

For the hand support apparatus 50, as best shown in FIGS. 4 and 10, optionally included is a cavity 120 disposed within the beam 85 between the principal 105 and minor 110 surfaces, wherein the elastic finger 220 having the primary end portion 225 and the opposing secondary end portion 230, is disposed therethrough the cavity 120 in a slidable engagement 300 such that the primary end portion 225 extends from the beam 85 and the secondary end portion 230 extends from an opposing side of the beam 85. The primary end portion 225 depends away from the principal surface 105 in a direction toward the first 130 and second 165 extension members to a primary terminal end portion 240 that has a means 245 for removable engaging the body retention feature 70, the secondary end portion 230 depends away from the principal surface 105 in a direction toward the first 130 and second 165 extension members to a second terminal end portion 241 that has a means 265 for removable engagement to an opposing body 60 retention feature 75. Wherein operationally, the first 145 and second 180 distal portions are drawn to be adjacent to the prime surface 65 via the elastic finger 220 with the minor surface 110 forming a non-contacting scaffold 270 over the string 81 and the principal surface 105 forming a hand rest 275 for a player 82 of the string musical instrument 55, wherein the hand support apparatus 50 is removably engagable to the string musical instrument 55. The slidable engagement allows the elastic finger 220 to be a single piece as between the primary end portion 225 and the opposing secondary end portion 230 for simpler construction.

Further optionally, on the hand support apparatus 50 the beam 85 can further comprises a plurality of cavities 120 and that are each positioned in a substantially parallel spaced apart manner 125 along the longitudinal axis 90 and further comprising a plurality of the elastic fingers 220 that are each positioned therethrough each of the cavities 120 resulting in the elastic fingers being in a spaced apart manner 280 along the longitudinal axis 90, see FIGS. 1 to 10, operationally for the purpose of symmetric hold down loading of the hand support apparatus 50 as against the prime surface 65, as shown in particular in FIGS. 1 and 2, plus in FIGS. 3, 5, 6, 8, and 9.

For the alternative embodiment of the hand support apparatus 50, as best shown in FIG. 11, via not having attachment of the elastic fingers 220 to the beam 85 or first 130 or second 165 extension members, utilizes a pair of elastic fingers termed an initial elastic finger 305 and a following elastic finger 320, each having primary end portions 310, 325 and opposing secondary end portions 315, 330 wherein the initial primary end portion 310 is adjacent to and in contact with the peripheral surface 115 and the initial primary end portion 310 depends away from the principal surface 105 in a direction toward the first distal portion 145 on an opposing end of the initial primary end portion 310 having a means 245 for removably engaging a body 60 retention feature 70. The initial secondary end portion 315 is adjacent to and in contact with the peripheral surface 115 opposite of the initial primary end portion 310 and the initial secondary end portion 315 depends away from the principal surface 105 in a direction toward the first distal portion 145 on an opposing end of the initial secondary end portion 315 having a means 265 for removable engagement to an opposing body 60 retention feature 75.

Further, FIG. 11 shows the following primary end portion 325 being adjacent to and in contact with an opposing end of the peripheral surface 115 and the following primary end portion 325 depends away from the principal surface 105 in a direction toward the second distal portion 180 on an opposing end of the following primary end portion 325 having a means 245 for removable engaging a body 60 retention feature 70. The following secondary end portion 330 is adjacent to and in contact with the opposing end of the peripheral surface 115 opposite of the following primary end portion 325 and the following secondary end portion 330 depends away from the principal surface 105 in a direction toward the second distal portion 180 on an opposing end of the following secondary end portion 330 having the means 265 for removable engagement to an opposing body 60 retention feature 75.

Wherein operationally, as shown in FIG. 11 the first 145 and second 180 distal portions are drawn to be adjacent to the prime surface 65 via the pair of elastic fingers 305, 320 pulling the first 130 and second 165 extension members toward one another and toward the prime surface 65 with the minor surface 110 forming a non-contacting scaffold 270 over the string 81 and the principal surface 105 forming a hand rest 275 for a player 82 of the string musical instrument 55, see FIG. 7, wherein the hand support apparatus 50 is removably engagable to the string musical instrument 55.

CONCLUSION

Accordingly, the present invention of a string musical instrument hand support apparatus has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface;

(b) a first extension member having a first axis, said first extension member having a first proximal portion and an opposing first distal portion with said first axis spanning therebetween said first proximal portion and said first distal portion, said first extension member also having a first perimeter surface, said first proximal portion is affixed to said beam first end portion on said minor surface, said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second extension member also having a second perimeter surface, said second proximal portion is affixed to said beam second end portion on said minor surface, said second axis is positioned substantially perpendicular to said beam longitudinal axis, wherein said first axis and said second axis are positioned substantially parallel to one another and said first extension member and said second extension member both extend away from said beam in substantially a same direction, such that said first extension member, said beam, and said second extension member form a "U" shape termed an arch, said arch having an arch axis, wherein said peripheral surface, said first perimeter surface, and said second perimeter surface forming a flank surface; and (d) an elastic finger having a primary end portion and an opposing secondary end portion, said primary end portion is affixed on one end to said flank surface and said primary end portion depends away from said principal surface in a direction toward said first and second extension members on an opposing end of said primary end portion having a means for removable engagement to a body retention feature, said secondary end portion is affixed on one end to said flank surface opposite of said primary end portion and said secondary end portion depends away from said principal surface in a direction toward said first and second extension members on an opposing end of said secondary end portion having a means for removable engagement to an opposing body retention feature, wherein operationally said first and second distal portions are drawn to be adjacent to the prime surface via said elastic finger with said minor surface forming a non-contacting scaffold over the string and said principal surface forming a hand rest for a player of the string musical instrument, wherein said hand support apparatus is removably engagable to the string musical instrument.

2. A hand support apparatus for a string musical instrument according to claim 1 further comprising a plurality of said elastic fingers that are each positioned in a spaced apart manner along said arch axis, wherein operationally for the purpose of a more symmetric hold down loading of the hand support apparatus as against the prime surface.

3. A hand support apparatus for a string musical instrument according to claim 1 wherein said elastic finger primary end portion and said elastic finger secondary end portion are affixed to said peripheral surface.

4. A hand support apparatus for a string musical instrument according to claim 1 wherein said elastic finger primary end portion and said elastic finger secondary end portion are affixed to said first perimeter surface.

5. A hand support apparatus for a string musical instrument according to claim 1 wherein said elastic finger primary end portion and said elastic finger secondary end portion are affixed to said second perimeter surface.

6. A hand support apparatus for a string musical instrument according to claim 1 wherein said means for removable engagement to the opposing body retention feature is constructed of a loop of said elastic finger that removably engages the opposing body retention feature.

7. A hand support apparatus for a string musical instrument according to claim 1 wherein said means for removable engagement to the body retention feature is constructed of a malleable soft surface "S" hook that is sized and configured to removably engage the body retention feature.

8. A hand support apparatus for a string musical instrument according to claim 1 wherein said first and second extension members are constructed of a pliable material.

9. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface, said beam further having a cavity disposed therethrough said beam, wherein said cavity is positioned between said principal surface and said minor surface;

(b) a first extension member having a first axis, said first extension member having a first proximal portion and an opposing first distal portion with said first axis spanning therebetween said first proximal portion and said first distal portion, said first extension member also having a first perimeter surface, said first proximal portion is affixed to said beam first end portion on said minor surface, said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second extension member also having a second perimeter surface, said second proximal portion is affixed to said beam second end portion on said minor surface, said second axis is positioned substantially perpendicular to said beam longitudinal axis, wherein said first axis and said second axis are positioned substantially parallel to one another and said first extension member and said second extension member both extend away from said beam in substantially a same direction, such that said first extension member, said beam, and said second extension member form a "U" shape termed an arch, said arch having an arch axis, wherein said peripheral surface, said first perimeter surface, and said second perimeter surface forming a flank surface; and (d) an elastic finger having a primary end portion and an opposing secondary end portion, said elastic finger is disposed therethrough said cavity in a slidable engagement such that said primary end portion extends from said beam and said secondary end portion extends from an opposing side of said beam, said primary end portion depends away from said principal surface in a direction toward said first and second extension members to a primary terminal end portion that has a means for removable engagement to a body retention feature, said secondary end portion depends away from said principal surface in a direction toward said first and second extension members to a second terminal end portion that has a means for removable engagement to an opposing body retention feature, wherein operationally said first and second distal portions are drawn to be adjacent to the prime surface via said elastic finger with said minor surface forming a non-contacting scaffold over the string and said principal surface forming a hand rest for a player of the string musical instrument, wherein said hand support apparatus is removably engagable to the string musical instrument.

10. A hand support apparatus for a string musical instrument according to claim 9, wherein said beam further comprises a plurality of said cavities and that are each positioned in a substantially parallel spaced apart manner along said longitudinal axis and further comprising a plurality of said elastic fingers that are each positioned therethrough each of said cavities resulting in said elastic fingers being in a spaced apart manner along said longitudinal axis, wherein operationally for the purpose of a more symmetric hold down loading of the hand support apparatus as against the prime surface.

11. A hand support apparatus for a string musical instrument according to claim 9 wherein said means for removable engagement to the body retention feature is constructed of a loop of said elastic finger that removably engages the opposing body retention feature.

12. A hand support apparatus for a string musical instrument according to claim 9 wherein said means for removable engagement to the body retention feature is constructed of a malleable soft surface "S" hook that is sized and configured to removable engage the body retention feature.

13. A hand support apparatus for a string musical instrument according to claim 9 wherein said first and second extension members are constructed of a pliable material.

14. A hand support apparatus for a string musical instrument having a body that includes a prime surface, the body including retention features, and a string retention bridge disposed upon the prime surface such that a string is suspended away from the prime surface, said hand support apparatus comprising:

(a) a beam having a longitudinal axis, said beam having a first end portion and an opposing second end portion with said longitudinal axis spanning therebetween said first end portion and said second end portion, said beam further having a principal surface and an opposing minor surface, wherein said principal surface and said minor surface span said beam both being substantially parallel to said longitudinal axis, said beam also having a peripheral surface;

(b) a first extension member having a first axis, said first extension member having a first proximal portion and an opposing first distal portion with said first axis spanning therebetween said first proximal portion and said first distal portion, said first extension member also having a first perimeter surface, said first proximal portion is affixed to said beam first end portion on said minor surface, said first axis is positioned substantially perpendicular to said beam longitudinal axis;

(c) a second extension member having a second axis, said second extension member having a second proximal portion and an opposing second distal portion with said second axis spanning therebetween said second proximal portion and said second distal portion, said second extension member also having a second perimeter surface, said second proximal portion is affixed to said beam second end portion on said minor surface, said second axis is positioned substantially perpendicular to said beam longitudinal axis, wherein said first axis and said second axis are positioned substantially parallel to one another and said first extension member and said second extension member both extend away from said beam in substantially a same direction, such that said first extension member, said beam, and said second extension member form a "U" shape termed an arch, said arch having an arch axis, wherein said peripheral surface, said first perimeter surface, and said second perimeter surface forming a flank surface; and (d) a pair of elastic fingers termed an initial elastic finger and a following elastic finger, each having a primary end portion and an opposing secondary end portion, said initial primary end portion is adjacent to and in contact with said peripheral surface and said initial primary end portion depends away from said principal surface in a direction toward said first distal portion on an opposing end of said initial primary end portion having a means for removable engaging a body retention feature, said initial secondary end portion is adjacent to and in contact with said peripheral surface opposite of said initial primary end portion and said initial secondary end portion depends away from said principal surface in a direction toward said first distal portion on an opposing end of said initial secondary end portion having a means for removable engagement to an opposing body retention feature, said following primary end portion is adjacent to and in contact with an opposing end of said peripheral surface and said following primary end portion depends away from said principal surface in a direction toward said second distal portion on an opposing end of said following primary end portion having a means for removably engaging a body retention feature, said following secondary end portion is adjacent to and in contact with said opposing end of said peripheral surface opposite of said following primary end portion and said following secondary end portion depends away from said principal surface in a direction toward said second distal portion on an opposing end of said following secondary end portion having a means for removable engagement to an opposing body retention feature, wherein operationally said first and second distal portions are drawn to be adjacent to the prime surface via said pair of elastic fingers pulling said first and second extension members toward one another and toward the prime surface with said minor surface forming a non-contacting scaffold over the string and said principal surface forming a hand rest for a player of the string musical instrument, wherein said hand support apparatus is removably engagable to the string musical instrument.

15. A hand support apparatus for a string musical instrument according to claim 14 wherein said means for removable engagement to the opposing body retention feature is constructed of a loop of said elastic finger that removably engages the opposing body retention feature.

16. A hand support apparatus for a string musical instrument according to claim 14 wherein said means for removable engagement to the body retention feature is constructed of a malleable soft surface "S" hook that is sized and configured to removable engage the body retention feature.

17. A hand support apparatus for a string musical instrument according to claim 14 wherein said first and second extension members are constructed of a pliable material.

* * * * *